US008720459B2

(12) United States Patent
Moulton

(10) Patent No.: US 8,720,459 B2
(45) Date of Patent: May 13, 2014

(54) ANTI-SLIP FOOT ASSEMBLY

(75) Inventor: Reynolds E. Moulton, Brooklyn, NY (US)

(73) Assignee: RW Truland, I, LLC, Reston, VA (US)

( * ) Notice: Subject to any disclaimer, the term of this patent is extended or adjusted under 35 U.S.C. 154(b) by 0 days.

(21) Appl. No.: 13/451,825

(22) Filed: Apr. 20, 2012

(65) Prior Publication Data

US 2013/0276845 A1 Oct. 24, 2013

(51) Int. Cl.
*A45B 9/04* (2006.01)

(52) U.S. Cl.
USPC ..... 135/77; 135/86

(58) Field of Classification Search
USPC ..... 135/77, 82, 86
See application file for complete search history.

(56) References Cited

U.S. PATENT DOCUMENTS

| | | | | | |
|---|---|---|---|---|---|
| 2,910,995 | A * | 11/1959 | Jacuzzi | ..... | 135/77 |
| 4,098,283 | A | 7/1978 | Tritle | | |
| 5,178,176 | A | 1/1993 | Fetterman | | |
| 5,307,828 | A | 5/1994 | Gardner | | |
| 6,131,593 | A * | 10/2000 | Greene et al. | ..... | 135/77 |
| 6,138,699 | A * | 10/2000 | Su | ..... | 135/82 |
| 6,883,530 | B2 * | 4/2005 | Kawakami | ..... | 135/84 |
| 7,159,830 | B2 | 1/2007 | Frank | | |
| 7,395,829 | B2 * | 7/2008 | Chapman | ..... | 135/82 |
| 7,748,396 | B2 | 7/2010 | Lasota | | |
| 2004/0107982 | A1 * | 6/2004 | Morris | ..... | 135/77 |
| 2009/0159107 | A1 * | 6/2009 | Davenport | ..... | 135/82 |
| 2010/0313925 | A1 * | 12/2010 | Jiang | ..... | 135/82 |
| 2011/0005559 | A1 * | 1/2011 | Daily | ..... | 135/68 |

* cited by examiner

*Primary Examiner* — Noah Chandler Hawk
(74) *Attorney, Agent, or Firm* — Adler Vermillion & Skocilich, LLP; Eric Adler

(57) ABSTRACT

An anti-slip foot assembly for a strut is disclosed. An embodiment of the anti-slip assembly includes a heel pad adapted to resist normal forces applied by the strut, a plurality of independently flexible toes adapted to resist the lateral forces that tend to cause slipping. A foot assembly with retractable cleat system is also disclosed.

13 Claims, 5 Drawing Sheets

ANTI-SLIP FOOT ASSEMBLY

CROSS REFERENCES TO RELATED APPLICATIONS

None.

FIELD OF INVENTION

The disclosed technology relates generally to anti-slip strut tips, and particularly, to an environment-engaging "foot" assembly adapted to reduce lateral slipping on rugged terrain.

BACKGROUND

The disclosed technology relates generally to anti-slip strut tips, and particularly, to a surface-engaging "foot" assembly adapted to reduce lateral slipping between the foot and surface.

Axial forces applied from the strut to the foot assembly (and in turn to a surface) have a normal force component and a lateral force component. The normal force is perpendicular to the ground. The lateral force is parrallel to the ground.

Unless the axial force from the strut is perfectly perpendicular to the surface, there will be a lateral component that will tend to cause the foot to slip along the surface. The force of friction between the foot assembly and the surface tends to resist slipping.

Many types of prior art feet fail to properly grip rugged terrain (including cracked surfaces, uneven sidewalks, pebbles and small obstacles, inclined surfaces, sand and gravel, and in various puddles of liquid). As a result, these prior art feet may not provide sufficient traction to counteract applied lateral forces, and the strut may slip.

Anti-slip features are desirable when the strut is a component of an ambulatory device, such as a cane, walker, crutch or forearm crutch. Anti-slip is particularly important for the forearm crutch. Typical users suffer from partial paralysis, cerebral palsy, or similar afflictions, and rely on the forearm crutch to support nearly all of their weight throughout the day. Since these devices are used to support significant portions of a user's bodyweight, any slipping between the device and environment can be devastating.

Such slipping can lead to the user's sudden loss of balance and stumbling, and may result in serious injury. Every year, an estimated 10,000 people suffer injuries—from broken bones to concussions—from falling during use of their forearm crutches.

There is a need for a foot assembly with improved gripping properties, especially on rugged terrain.

SUMMARY

The disclosed anti-slip foot assembly provides a deformable surface adapted to securely grip environmental surfaces. A combination of structural design choices and material selection provides an improved contact path between foot and environment. The anti-slip foot assembly may be used as the terminal component of a strut, and in particular, an ambulatory device, to provide confident support, even when used on rugged terrain.

The foot assembly may be attatched to any strut that might benefit from non-slip properties. This includes, without limitation, crutch, cane, walker, forearm crutch, hiking pose, prosthetic foot, robotic foot, ladder, outrigger, or chair.

In a preferred embodiment, the anti-slip foot assembly is securable to a forearm crutch. Flexible "toes" surround a central heel pad. The toes are adapted to resist lateral slipping forces, while the heel pad is adapted to resist axial forces from the strut (for example, in the crutch embodiment, to support the user's weight).

The toes are manufactured from an elastomer, allowing them to flex independently of each other. The allocation of forces among the toes may vary depending on nature of the surface they engage. When the foot contacts the ground, and the strut applies a force, the foot assembly first distributes the applied force over the separate toes. If one of the toes encounters an obstacle (such as a pebble), the remaining toes will still engage the ground and provide sufficient contact area for traction.

If the foot assembly comes into contact with a wet surface (for example, a puddle), the foot disperses liquid between the channels of the "toes," further improving the anti-slip properties.

The disclosed embodiments are illustrative, not restrictive. While specific configurations of the foot assembly have been described, it is understood that the present invention can be applied to a wide variety of strut tip assemblies. There are many alternative ways of implementing the invention.

BRIEF DESCRIPTION OF THE DRAWINGS

Various embodiments of the invention are disclosed in the following detailed description and accompanying drawings.

DETAILED DESCRIPTION AND PREFERRED EMBODIMENT

The following is a detailed description of exemplary embodiments to illustrate the principles of the invention. The embodiments are provided to illustrate aspects of the invention, but the invention is not limited to any embodiment. The scope of the invention encompasses numerous alternatives, modifications and equivalent; it is limited only by the claims.

Numerous specific details are set forth in the following description in order to provide a thorough understanding of the invention. However, the invention may be practiced according to the claims without some or all of these specific details. For the purpose of clarity, technical material that is known in the technical fields related to the invention has not been described in detail so that the invention is not unnecessarily obscured.

Terminology a. Friction—is not used in its strict tribological sense, but in broader definition, encompassing traction as well as any force or combination of forces that tend to resist sliding motion between two bodies.

b. Traction—is the physical process in which a tangential force is transmitted across an interface between two bodies resulting in stoppage of relative motion between the bodies.

Figure 1:
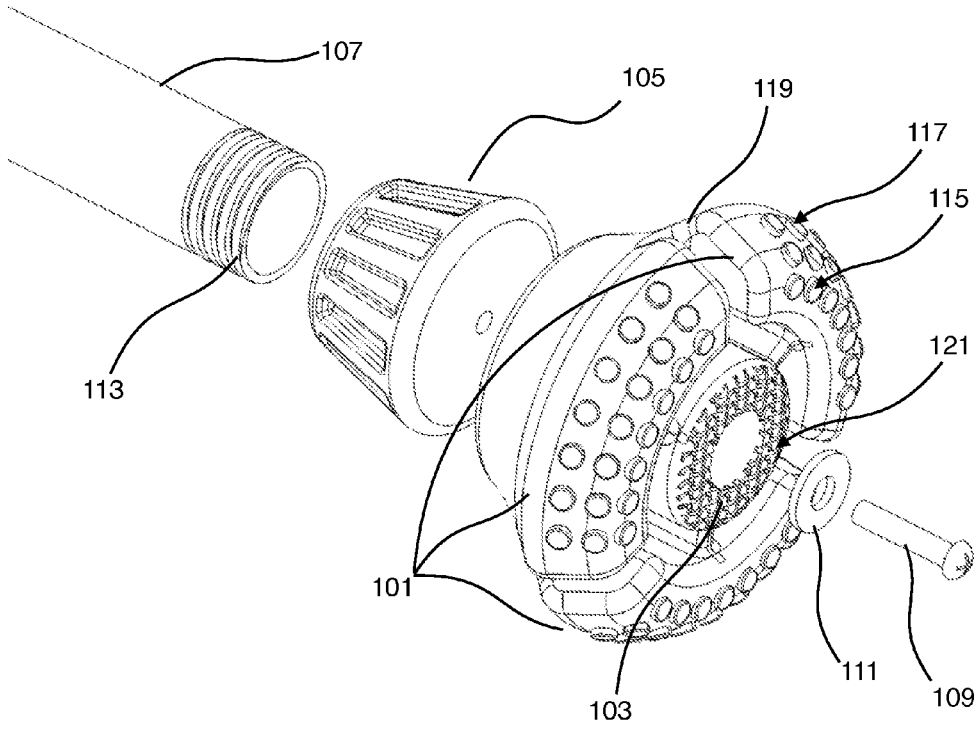
FIG. 1 illustrates an exploded view of a foot assembly embodiment.

FIG. 1 illustrates an exploded view of an anti-slip foot assembly embodiment.

Overview. A preferred embodiment of the foot assembly includes three flexible toes 101 surrounding a heel pad 103.

The foot is bolted to an adapter 105, which is in turn secured to a strut 107. A fastener 109 runs through a washer 111 and then through the foot and the adapter 105, securing the two components together. The strut 107 includes a threaded end 113. The adapter 105 includes a socket threaded to accept the threaded end 113 of the strut 107. This embodiment is securable to the ground-engaging end of a forearm crutch. In such circumstances, the foot assembly is sometimes referred to as a "ferrule." In other embodiments, the design may be secured to any strut that may benefit from anti-slip properties.

Tread. The ground-engaging face 115 of the toes is covered in a tread pattern. In the preferred embodiment, the peripheral edges 117 of the toes are also covered in a tread pattern. The tread pattern further increases anti-slip properties on rough terrain.

Toes—Function. The toes 101 are designed to securely engage a surface and prevent lateral slip. The toes 101 also absorb initial shock upon impact with the ground. If one of the toes 101 encounters an obstacle, it can flex independently to allow the remaining toes to firmly engage the ground.

Channels. Channels 119 between the toes allow liquid to disperse from beneath the foot. When the foot is used on a puddle or wet surface, the channels allow liquid to flow away from the toe-ground contact area. In other embodiments, the individual toes touch each other, without channels in between.

Size. In the preferred embodiment, the height of the foot assembly is about 1.5 inches, the widest circumference at the toes is 9.3 inches, and the narrowest circumference of the foot assembly is 4.8 inches. However, other embodiments may take different sizes. For example, the foot assembly may be miniaturized for tiny robotic appendages, or scaled up for industrial uses, such as outriggers.

Material. In the preferred embodiemnt, the toes are manufactured from an material with an elastic modulus of between 0.2 and 0.4 GPa, and with sufficient toughness (tear-resistance) to withstand cyclical engagement with rugged outdoor surfaces. Acceptable materials include, without limitation, elastomers such as a purlyurethane blend; an isoprene; a polyisoprene; a natural rubber; a silicone; a butyl rubber (IIR, BIIR, or CIIR) or a cross linkage of EPDM rubber and polypropylenesantoprene.

Heel Pad. The preferred embodiment includes a heel pad 103 arranged at a center of the foot. The pad is designed to support axial forces on the strut. A surface-engaging face of the heel pad 121 includes a tread pattern.

Material. The central heel pad is manufactured from an elastomer such as natural rubber, an isoprene, a silicone or a santoprene.

Figure 2:
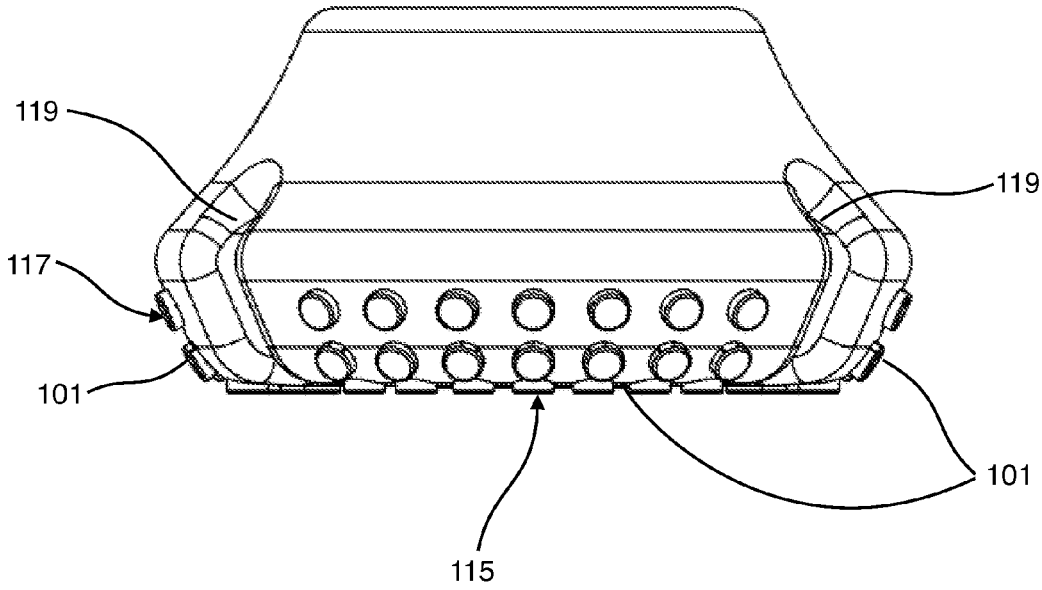
FIG. 2 illustrates a side view of a non-slip foot embodiment.

FIG. 2 illustrates a side view of an anti-slip foot assembly embodiment. The toes 101 are covered in a bottom tread patter 115 and a side tread pattern 117. The toes are separated by channels 119.

Figure 3:
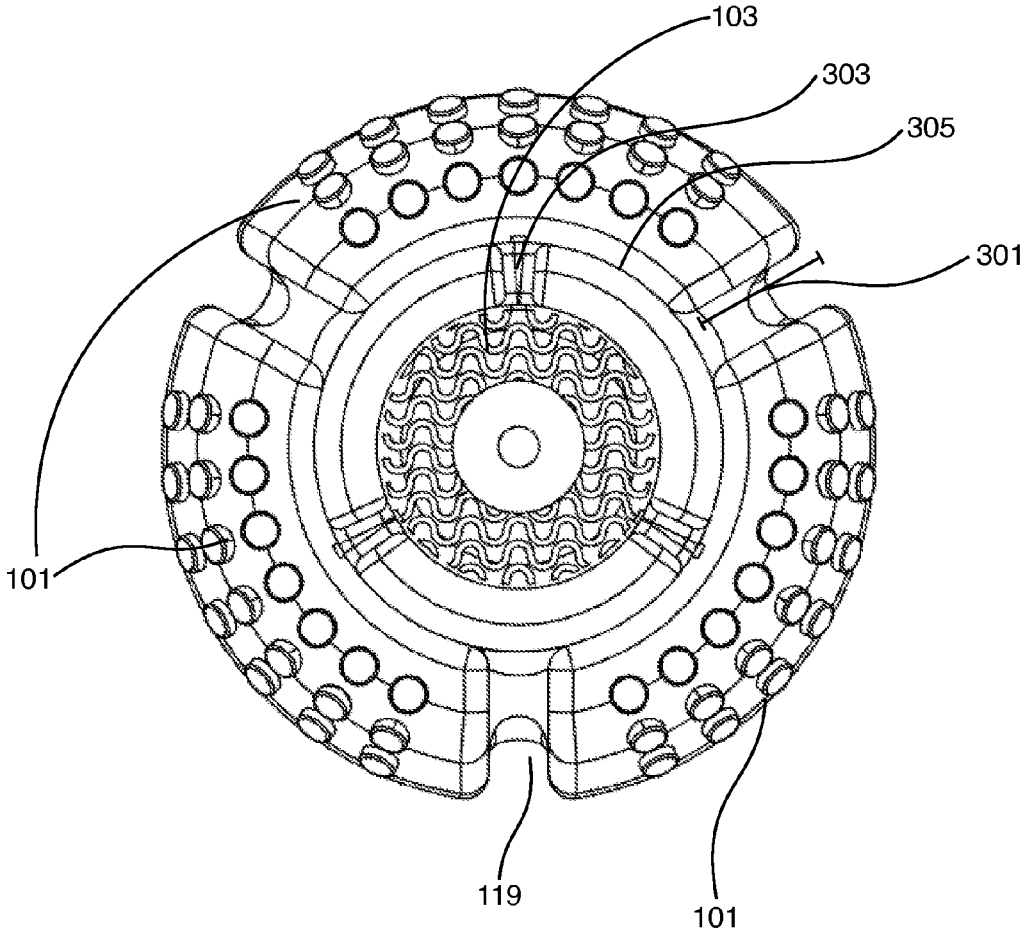
FIG. 3 illustrates a bottom view of a non-slip foot embodiment.

FIG. 3 illustrates a bottom view of an anti-slip foot assembly embodiment. Three toes 101 surround a heel pad 103. Channels 119 separate the toes 101. The width of the toes 301 is between ¼ and 1 inch.

In another embodiment, the toe width is between ⅓ to 1/10 of the outer circumference of the foot assembly. The lower face of the toes may be curved up away from the lower plane of the heel pad.

Toe flexibility may be reduced by adding a bridge 303 from the toe's inner face 305 to the heel pad 103.

Retractable Spike Assembly. In another embodiment, the foot assembly includes a retractable cleat assembly.

Figure 4:
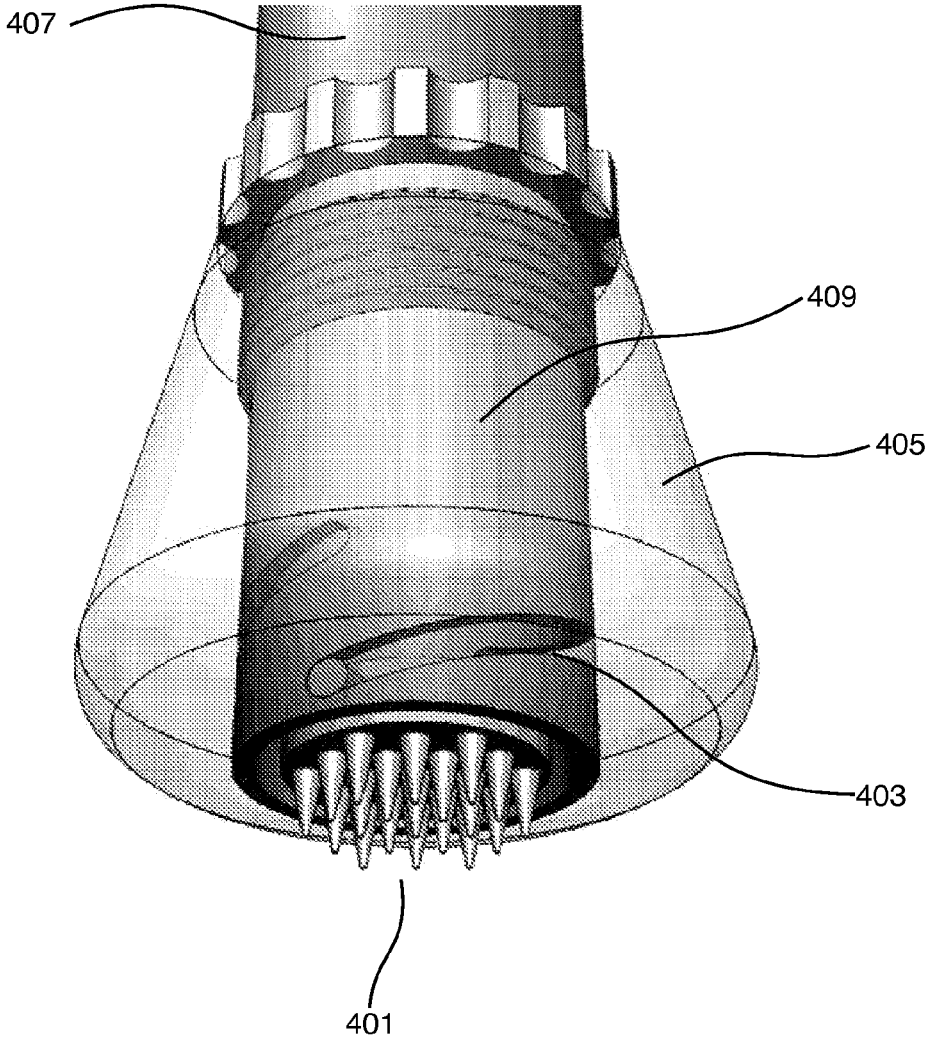
FIG. 4 illustrates a foot assembly with a retractable cleat.

FIG. 4 illustrates an alternate embodiment with a retractable spike assembly. In this embodiment, a plurality of retractable cleats 401 are provided on the bottom of an internal "power screw" or "rack and pinion" arrangement 403. This embodiment may be particularly useful for strut tips that are used on both icy and non-icy surfaces. On icy surfaces, the cleats may be extended for improved traction. On other surfaces, the cleats are retracted to minimize wear.

The outer face 405 of the foot assembly may be rotated relative to the strut 407. An inner face of the foot assembly is threaded. When the foot assembly is rotated, the cleats 401 below the lower face of the foot assembly, or retract the cleats into the foot assembly housing 409.

Material. The retractable cleats may be manufactured from a metal such as stainless steel or aluminium alloy. The power screw housing may be manufactured from a polycarbonate plastic material.

Figure 5:
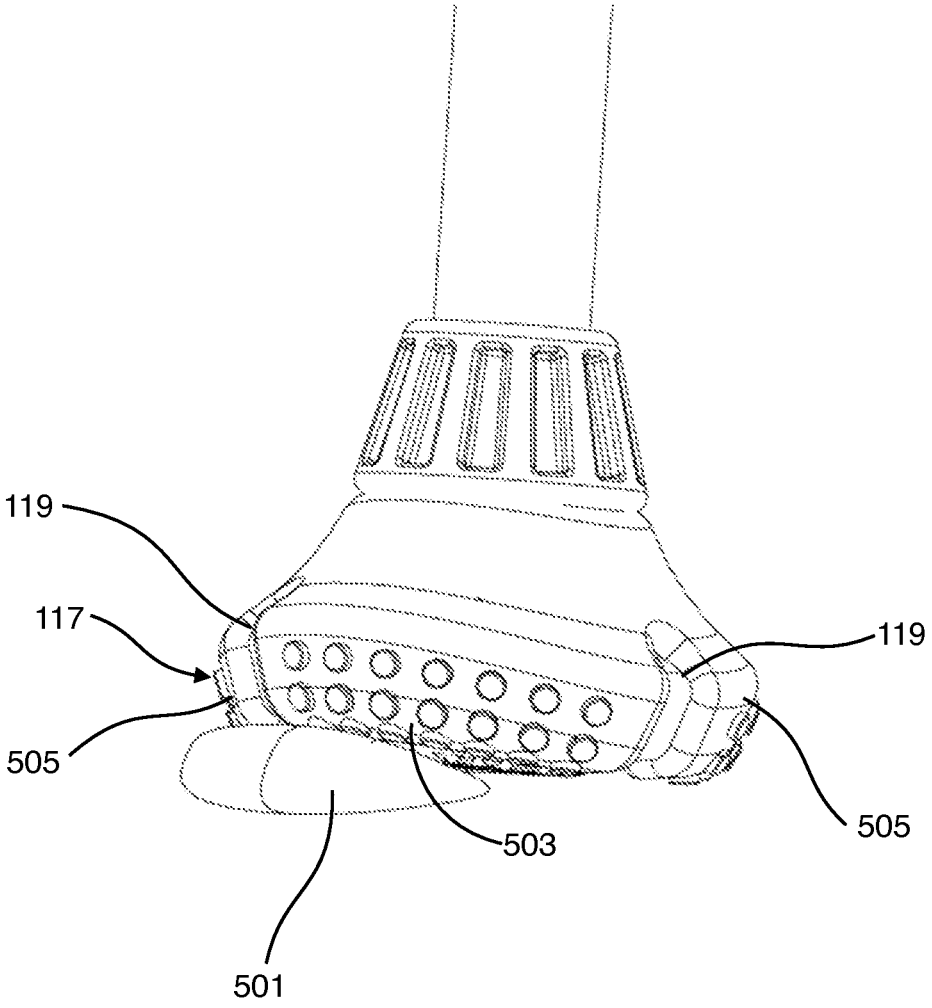
FIG. 5 illustrates a foot assembly contacting a surface obstacle.

FIG. 5. FIG. 5 illustrates a perspective view of an anti-slip foot assembly embodiment in use. A first toe 503 of the foot assembly has come into contact with an obstacle 501 (for example, a pebble). The first toe 503 flexes independently to conform to the contours of the surface obstacle 501. The remaining toes 505 remain securely engaged to the ground surface. This provides improved traction, even on rugged terrain.

Although embodiments have been described in detail, the invention is not limited to the details provided. There are many alternative ways of implementing the invention. The disclosed embodiments are illustrative, not restrictive.

What is claimed is:

1. An anti-slip foot assembly comprising, a. a plurality of toes, a heel-pad, a strut-socket, and a plurality of channels between the toes and heel-pad, wherein, b. the strut-socket is securable to a strut, c. the toes extend from the foot assembly and are independently flexible to conform to the contours of a surface obstacle;

d. the heel-pad extends from the foot assembly to the same level as the toes, allowing the heel-pad and toes to be in concurrent contact with a supporting surface, e. the plurality of channels between the toes and the heel-pad are of sufficient depth to allow independent flexibility of the toes, f. the strut-socket is centrally located on an upper face of the foot assembly, g. the toes radiate around a lower face of the foot, h. the heel-pad is located in the center of the toes, and i. the heel-pad is aligned to the axis of the strut-socket.

2. The anti-slip foot of claim 1, wherein, a. the depth of the channel between the toes and the heel-pad is sufficient to allow a liquid to disburse from beneath the foot.

3. The anti-slip foot of claim 1, wherein, a. the depth of the channel between the toes and the heel-pad are is least ½ of the height of the foot.

4. The anti-slip foot of claim 1, wherein, a. the depth of the channel between the toes and the heel-pad are is least ¼ of the height of the foot.

5. The anti-slip foot of claim 1, wherein the heel-pad includes a. a surface-engaging face, b. and wherein the surface-engaging face is covered by a tread pattern.

6. The anti-slip foot of claim 1, wherein a. the ground-engaging face of the toes are covered by a tread pattern.

7. The anti-slip foot of claim 1, wherein, a. the lower ground-engaging surface of the toes are covered by a tread pattern, and b. and outer surface toes are covered by a tread pattern to increase grip against non-horizontal obstacles.

8. The anti-slip foot of claim 1, a. wherein the outer circumference of the anti-slip foot is between 15 and 30 cm.

9. The anti-slip foot of claim 1, wherein a. the largest circumference of the anti-slip foot is between 50 and 100 cm.

10. The anti-slip foot of claim 1, wherein a. the largest circumference of the anti-slip foot is between 1 and 5 cm.

11. The anti-slip foot of claim 1, wherein a. the toes that are independently flexible to conform to the contours of a surface obstacle are manufactured from an elastomer selected from the group consisting of an isoprene, a natural rubber, a vulcanized natural rubber, a silicone and a cross linkage of EPDM rubber and polypropylenesantoprene.

12. The anti-slip foot of claim 1, wherein a. the toes are manufactured from an material with an elastic modulus of between 0.2 and 0.4 GPa.

13. The anti-slip foot of claim 1, wherein a. the toes are manufactured from an elastomer with a density of 0.75 to 2Mg/m3.

* * * * *